US006302678B1

(12) United States Patent
Mansfeld

(10) Patent No.: US 6,302,678 B1
(45) Date of Patent: Oct. 16, 2001

(54) SETTING DEVICE FOR BENDING LAYER MATERIAL MORE PARTICULARLY PAPER

(75) Inventor: Markus Mansfeld, Dettingen/Teck (DE)

(73) Assignee: bielomatik Leuze GmbH & Co. (DE)

( * ) Notice: Subject to any disclaimer, the term of this patent is extended or adjusted under 35 U.S.C. 154(b) by 0 days.

(21) Appl. No.: 09/049,731

(22) Filed: Mar. 27, 1998

(30) Foreign Application Priority Data

Mar. 28, 1997 (DE) ..... 197 13 207

(51) Int. Cl.[7] ..... B65H 23/34

(52) U.S. Cl. ..... 425/374; 425/335; 162/197; 162/270; 493/459; 493/461

(58) Field of Search ..... 162/197, 270; 425/374, 335; 493/459, 461

(56) References Cited

U.S. PATENT DOCUMENTS

| | | | | |
|---|---|---|---|---|
| 2,070,505 | | 2/1937 | Beck | 162/271 |
| 3,649,447 | * | 3/1972 | Turner | 162/197 |
| 3,661,703 | * | 5/1972 | Shelor | 162/270 |
| 3,772,145 | * | 11/1973 | Notbohm | 162/273 |
| 4,013,284 | | 3/1977 | Demetre | 162/271 |
| 4,111,745 | | 9/1978 | Manfredi | 162/271 |
| 4,539,072 | * | 9/1985 | Frye et al. | 162/271 |
| 5,009,749 | * | 4/1991 | Cederhollm et al. | 162/197 |
| 5,154,688 | | 10/1992 | Boyd | 162/271 |
| 5,269,743 | * | 12/1993 | Sakuma | 162/271 |
| 5,539,511 | * | 7/1996 | Wenthe, Jr. et al. | 162/270 |
| 5,637,070 | * | 6/1997 | Sasai | 162/271 |

FOREIGN PATENT DOCUMENTS

| | | |
|---|---|---|
| 623 285 | 5/1981 | (CH) . |
| 4 83 673 | 10/1929 | (DE) . |
| 26 46 281 | 4/1977 | (DE) . |
| 38 33 804 | 6/1989 | (DE) . |
| 296 00 403 | 3/1996 | (DE) . |
| 195 06 465 | 8/1996 | (DE) . |
| 0 374 827 | 6/1990 | (EP) . |
| WO94/21546 | 9/1994 | (WO) . |

* cited by examiner

*Primary Examiner*—Nam Nguyen
*Assistant Examiner*—Thu Khanh T. Nguyen
(74) *Attorney, Agent, or Firm*—Akerman Senterfitt

(57) ABSTRACT

For levelling webs of paper (3) gaps (20) are provided, each defined by a deflection roll (17) and a stationary bending face (16). For changing the wrap angle at the bending face (16) and also for non-bended passage of the web (3) through the device (1) the deflection roll (17) is transferable into varying positions powered by a positioning device (30). Thereby high speed operation with reliable function and simple construction are achieved.

5 Claims, 4 Drawing Sheets

SETTING DEVICE FOR BENDING LAYER MATERIAL MORE PARTICULARLY PAPER

BACKGROUND OF THE INVENTION

1. Field of the Invention

Figure 1:
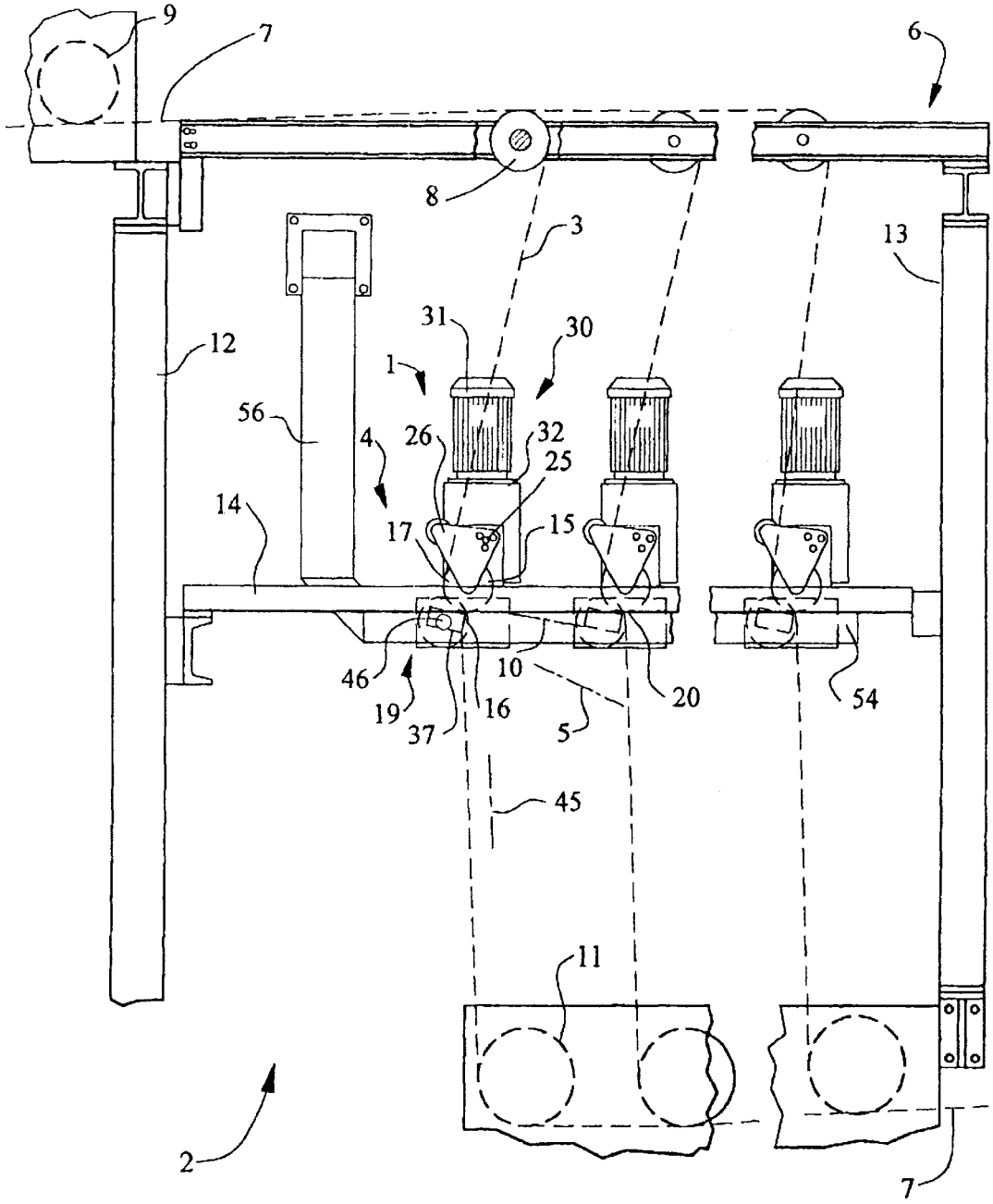

The invention relates to a device with which flexural or elastic materials can be worked in achieving a desired non-stressed shape, such as a flat shape. Such materials may be substrates or other rollable materials having a constant thickness which are worked as individual sheets or as an endless material web.

2. Description of the Background

Due to it being supplied as a reeled material, for instance, paper tends to curl, i.e. a portion of the web spread out flat is subject to an inherent bending stress and thus tends to curve or curl to relieve the stresses on release of external forces. However, it may also be wanted to bend or work a flat layer which is planar when free of stress so that it assumes a curved position. In any case, bending breaks a predetermined stress by moving the material on its face to which it is to be curved relative to a bending face. In this arrangement the material defines an angle of wrap in the portion coming into contact with the bending face. This angle of wrap is determined by the position of a deflector or guide for the material next the bending face. This deflector may be provided upstream and/or downstream of the bending face. For modifying the angle of wrap or for optionally working both faces of the material the deflector arrangement and the bending face means are expediently adjustable relative to each other. For this purpose the bending face may be positioned on the device frame so that it can be adjusted relative to the deflector during the entire bending operation, e.g. to transpose material sections in sequence having continuously changing tendencies into the same, non-stressed planar shape or the like. Such an adjustment may, however, result in a bulky configuration involving complicated control and inertia in control movements which makes it difficult to quickly react to varying curl tendencies or other properties of the material. If the length of the material section tensioned freely or linearly between the bending face and the deflection face is greater than the deflection radius of the deflection face the aforementioned drawbacks are likewise given and in addition to this material section may oscillate at high running speeds to the detriment of consistent good quality working.

OBJECTS OF THE INVENTION

An object is to overcome the drawbacks of known configurations or of the kind described. A wide variety of stresses should be introduceable into the material by simple constructional means.

SUMMARY OF THE INVENTION

In accordance with the invention the guiding face forming the deflection face and the bending face define as boundaries a relatively narrow gap which permits material to pass preferably free of compression stress. The clear width or the like of the gap is variable so that its minimum width is many times smaller than the cited deflection radius when the material wraps the bending face. This width can be measured in an axial plane of the deflection passing through the center of the bending face or of the angle of wrap. The minimum width may also be smaller than half, a quarter or a tenth of the deflection radius or smaller than 50 or 30 times the thickness of the material so that the free running zone between the two guiding faces is maximally as large as the deflection radius or smaller as compared thereto corresponding to one of the cited values.

Although in this case too, the bending face is positionally adjustable during bending operation it is, however, particularly expedient when thereby only the deflection is adjusted transverse to the deflection axis since then the distances and time required maximally for positioning are relatively small. The deflection face can thus be set tangentially to the plane of a flank connecting to the bending face and the tangential point can be continuously displaced from a position remote from the flank and opposing the bending face up to the flank face and a zone behind the bending face. This is especially achieved when the associated positioning axis is located away from the deflection axes of the deflection face upstream or downstream next to the bending face and thus the gap width is slightly altered by the positioning motion.

A web of paper to be subsequently worked is expediently secured with its leading edge to the overlapping trailing edge of an advanced paper web, e.g. by an adhesive tape before these ends or the seam reaches the working station. If the seam is passed on an arc or angle of wrap through the working engagement at the bending face or the like it may easily tear. This is why the guiding faces are mutually displaceable in a sudden short impulse such that the seam can be guided past one or both guiding faces without curvature or even contact, thus excluding damage.

Although the device can be made for bending engagement only on one face of the material, it is expediently configured for alternating bending engagement on both faces. For this purpose two separate deflecting faces are displaceable in common and two separate bending faces are mutually and separately adjustable relative to the device frame. The deflecting faces provided for this purpose, on the one hand, and the bending faces on the other are facing each other and are minimally spaced from each other by a spacing which is maximally as large as the deflection radius or smaller. The deflecting faces may be formed by rotational faces or rollers, the clear width there between as measured in their common axial plane being smaller than their radius. At both deflecting faces and at the bending face the material may be simultaneously guided and thus curved alternatingly in opposite directions.

In accordance with the invention fluid or suction means is provided with which particles of dust, paper or the like can be permanently exhausted more particularly in the region of the guiding faces or gap. A suction port adjoining the gap or the guiding faces is shaped expediently, as viewed axially, other than circular, more particularly oblong so that in the associated gap boundary only a single suction orifice extending over the full gap length is necessary. Such a configuration is substantially simpler to produce than orifices arranged in a grid pattern.

The bending face is expediently arranged on a plate or slat-like or similar type reversible body which can be replaced as a module without needing to destroy any part of it or its fastener means and can be thus reinserted in reversed positions so that a further bending face of three, four or more such faces is in place for workingly engaging the material. Accordingly, these bending faces working alternatingly may be configured in one part. However, the bending face may also be formed by a rotational face, for example, a round rod, instead of an edged face.

To facilitate changing the bending body, together with a support body such as a rod, where necessary, its fastening to the device frame is suitable for radial removal, i.e. for removal transversely to the longitudinal direction of the bending face or to the width extension of the material. Removing or changing can thus also be done when the material regularly passes through the device, the same applying also to the deflector arrangement or the individual deflector bodies.

In a further aspect of the invention the guiding faces are slantingly adjustable relative to each other or relative to the material or the running direction or the like, more particularly as viewed at right angles to the longitudinal direction of the guiding faces so that varying wrap angles or gap widths can be achieved over the width of the material. This adjustment is possible during bending operation.

BRIEF DESCRIPTION OF THE INVENTION

Figure 2:
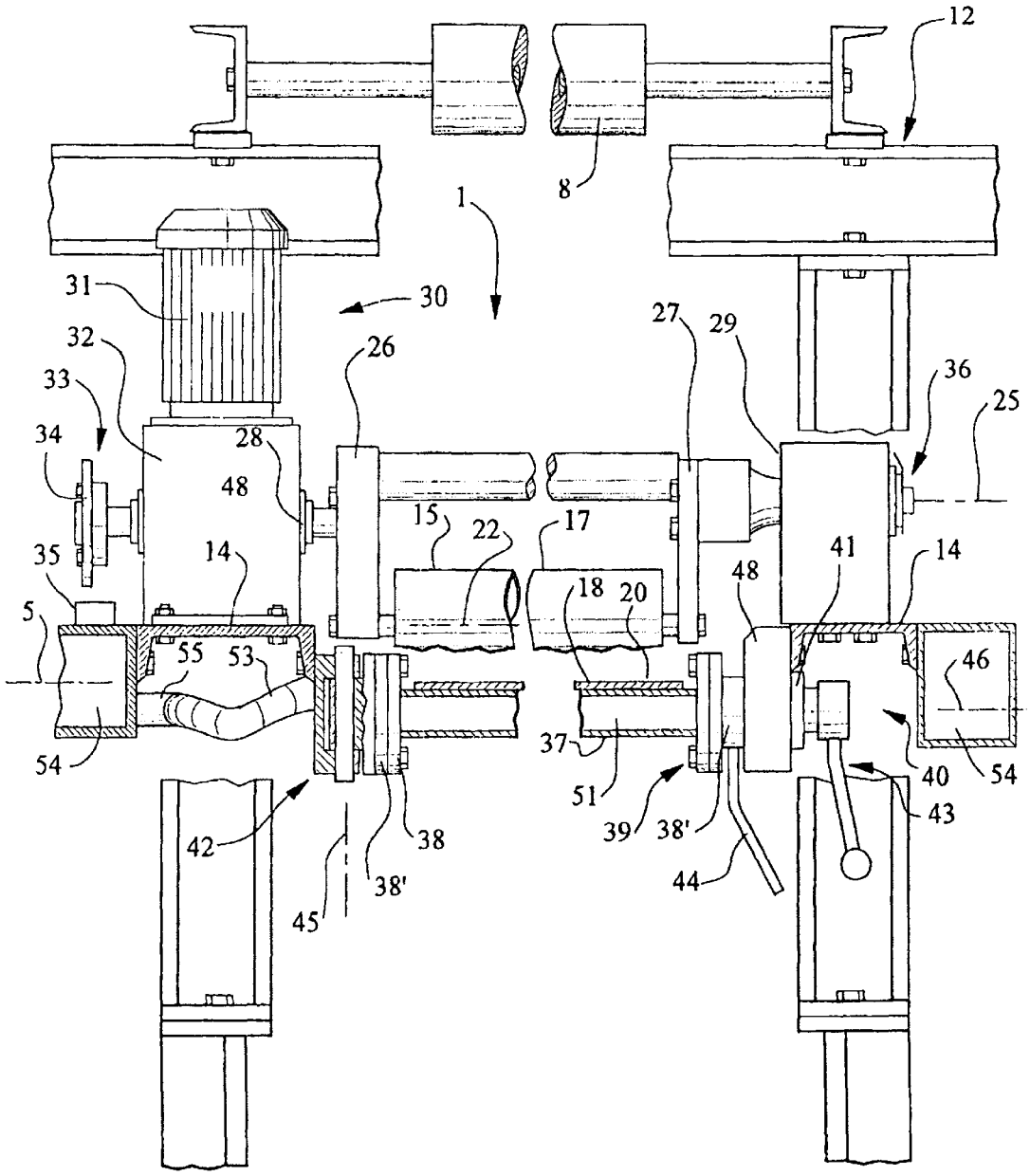
Figure 3:
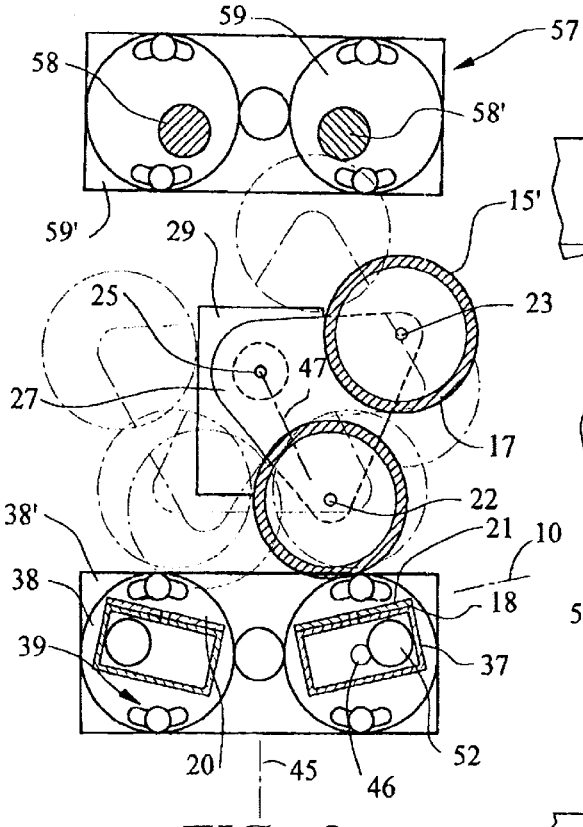
Figure 7:
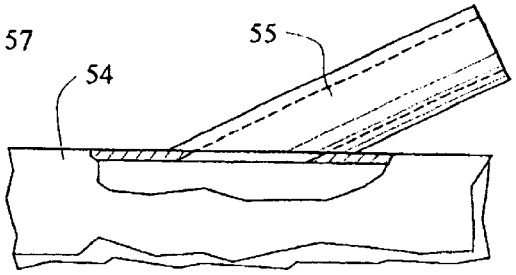
Figure 6:
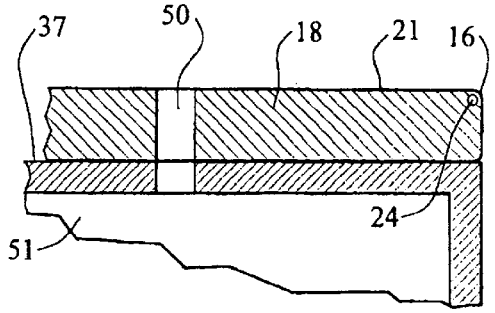
Figure 5:
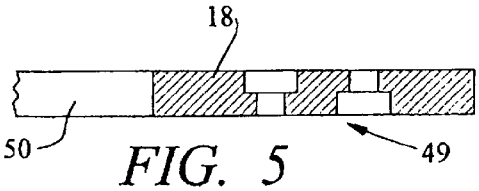
Figure 4:
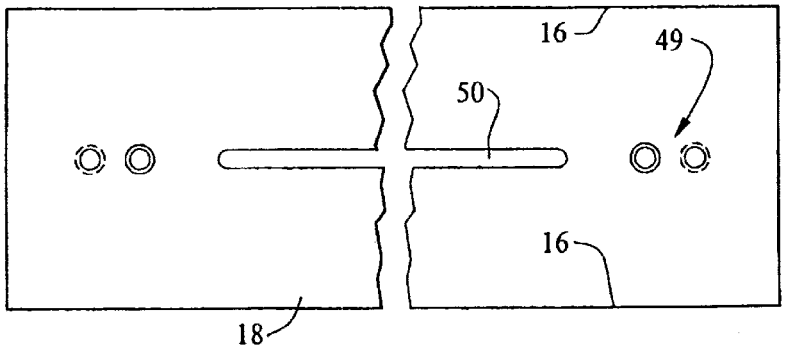
Figure 8:
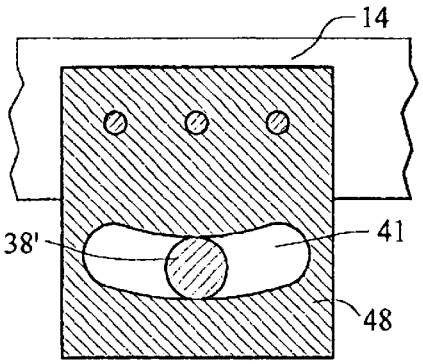
Figure 9:
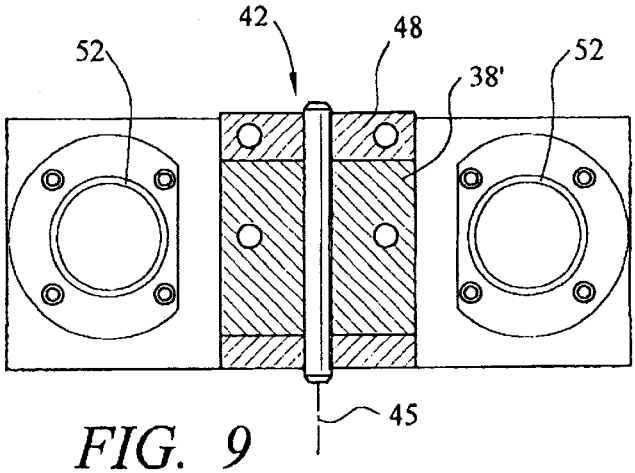
Figure 10:
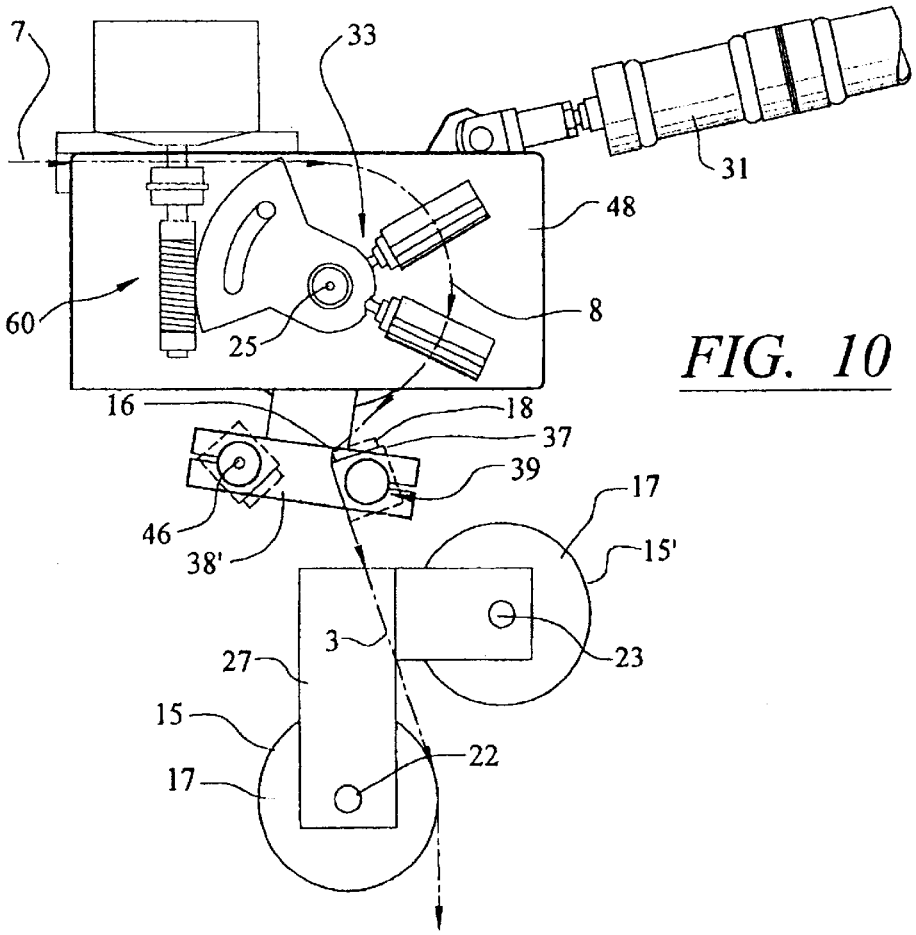

Example embodiments of the invention are explained in more detail in the following and illustrated in the drawings in which:

FIG. 1 is a side view of a device for a multi-ply material web,

FIG. 2 is a partially sectioned view as seen from the right of a single subdevice of the arrangement as shown in FIG. 1, FIG. 3 is a section through the bending tools as shown in FIG. 2, FIG. 4 is a view of a bending body as shown in FIGS. 2 and 3, FIG. 5 is a longitudinal section through the bending body as shown in FIG. 4, FIG. 6 is a scrap view of the bending body as shown in cross-section in FIG. 3 on an enlarged scale, FIG. 7 is a scrap view of the suction connection of the bending body, FIG. 8 is a cross-sectional view of the mounting arrangement of one end of the bending body, FIG. 9 is a cross-sectional view of the bearing means of the other end of the bending body, and FIG. 10 is a scrap view of a further embodiment of the subdevice as shown in FIG. 1.

DESCRIPTION OF THE PREFERRED EMBODIMENTS

As shown in FIG. 1 multiple equal bending or subdevices 1 are arranged in a station 2 horizontally juxtaposed and spaced from each other by an amount which is smaller relative to the space requirement for a device 1, each of which is designed to work a separate material 3 in a working zone. In these working zones the materials 3 have parallel running directions 4 inclined downwards in running planes 5 parallel to each other. Each device 1 is arranged as a module for facilitated removal from a frame 6. A multi-layer material web 7 from which the webs 3 located initially congruently on each other is fed horizontally and above the devices 1 to station 2 from separate reel stands, firstly aligned at a deflection 9 and then downstream thereof the individual materials 3 are each deflected in sequence from the web 7 at an upper deflection 8 and fed extended directly to the associated device 1. From the working zone each material 3 is fed extended to devices 11 located below at which the materials 3 are placed one on the other in sequence to again form the web 7.

In front and behind of the devices 1 the frame 6 comprises a portal 12 and 13 respectively each composed of rods, the vertical supports of these portals being connected to each other via horizontal girders 14 located on both sides of the material 3. On their tops these members 14 mount the device modules 1 and can be removed together therewith as a unit from the remaining frame 12, 13. The upper ends of portals 12, 13 are likewise interconnected with girders on which the deflectors 8 or rolls are rotatively mounted in sequence.

The single-layer material 3 is fed as an endless web to the working zone of the individual devices 1 via a cylindrical guide and deflection face 15 which the material 3 wraps over an angle of maximally 90°. From face 15 the material passes stretched directly to a guide or bending face 16 formed by a corner edge rounded in cross-section. Guide face 15 is formed by a rotating roll or deflector body 17 and the bending face 16 by a stationary bending body 18 comprising rectangular flat cross-sections throughout, which like deflector body 17 covers the full width of the material. Any soilage appearing in the working zone or in the vicinity of gap 20 is continuously removed pneumatically by a flow, for example by suction means 19. The plane 10 of gap 20 slanting downwards in the direction 4 coincides with the bending flank of the bending face 16 which directly opposes guiding face 15 and is formed by an entirely planar larger face 21 of body 18. The running plane 5 is steeper than face 21 so that the material 3 passes through the gap 20 from one gap boundary 15 to the opposite gap boundary 16 at an acute slanting angle before then being deflected on bending face 16 downwards and away from face 15 over an angle of less than 90°. The free length of material 3 between the two boundaries 15, 16 is extremely short, but continuously variable. This length is smaller than the largest cross-sectional extension of body 17 or 18 or is half or a quarter thereof.

Guiding face 15 is curved about a horizontal deflector axis 22, oriented parallel to running plane 5 and at right angles to direction 4. Bending face 16 is curved about a bending axis 24 orientable parallel thereto. The two convex curved faces 15, 16 greatly differ in their radius of curvature, the radius of face 15 being at least 10 to 20 times or 30 times larger than the radius of face 16. Face 15 is adjustable about a positioning axis 25 oriented parallel to axis 22, the positioning axis 25 being fixed on frame 6 and located on the side of axis 22 or of body 17 facing away from gap 20 or plane 10.

The two ends of body 17 are secured or rotationally mounted on two supporting cheeks 26, each of which is rotationally mounted about axis 25 over at least 120° or 360° with a bearing 28 and 29 respectively located at the corresponding outer side. Unit 17, 26, 27 can be radially removed from frame 6, where necessary, together with bearings 28, 29. For precise, continuous adjustment about axis 25 positioning means 30 are provided which comprise an upright rotational motor 31 and a gear such as an angular gear 32 directly flanged thereto. Gear 32 is secured to the upper side of one member 14 and operates self-locking. The corresponding cheek 26 is secured directly to the freely protruding output journal of gear 32 so that the latters gear bearing directly forms the corresponding sole bearing 28 for positioning unit 17, 26, 27, eliminating the need for any further separate or frame-fixed bearing on this side. The positioning means 30, 40, 42, 43 or the suction means 19 may be arranged optionally on both sides of gap 20 by e.g. arranging gear 32 optionally on each one of members 14 and the connection 52, 53, 54, 55 optionally in the region of each one of members 14. Due to this arrangement the operator side of the device 1 may be located optionally on either the one side or the other and, where necessary, maintained free of means 19, 30, 42.

For adjusting unit 17, 26, 27 control means 33 are provided on the side of gear 32 facing away from this unit. Means 33 comprise a control cam 34 located in axis 25 of the journal and arranged directly on the other journal of the same gear shaft. The periphery of cam 34 acts on a sensor 35, such as an inductive transducer, so that by setting a variable signal value the positioning means 30 is stopped when the corresponding position of guiding body 17 is attained. An analog indication of the position is provided by an optical display 36 on the outer side of the other bearing 29.

The flat or rod-type body 18 having constant outer cross-sections full-length is secured replaceably to a rod or supporting body 37 which is larger in cross-section and which is cross-sectionally configured as a flat rectangular tubular body carrying intimately adjoined body 18 on one of its two wider outer faces. Due to this the edge faces of body 18 adjoining edges 16 are located in the planes of the two outer faces of body 37 which are narrower or located at right angles thereto. The ends of unit 18, 37, more particularly only the ends of body 37 are rigidly connected with circular disk-shaped flanges 38 which are replaceably fixed to plate-shaped supporting flanges 38' of frame 2 by axial bolts which can be screwed into place toward outside. Once the axial bolts have been released unit 18, 37 can be removed radially from supporting flanges 38' or conversely reinstalled.

Face 16 is manually adjustable by positioning means 39 or 40 relative to unit 17, 26, 27 and frame 6 separately about two positioning axes 45, 46 located at right angles to each other, namely by the positioning means 40 during operation and by the positioning means 39 when operation is stopped. Axis 46 oriented parallel to face 16 and to axes 22, 25 is located on the side of face 16 facing away from gap 20, 10 roughly in the center axis of supporting body 37 or of the associated flanges 38. For passage of the cited axial bolts these flanges 38 comprise slots curved about axis 46 so that the inclination of the face 16 and gap flank 21 can be steadily varied and then locked in place by clamping action of the axial bolts. The flank 21 is located in one position of unit 15, 26, 27 at right angles to the common axial plane 47 of axes 22, 25, this axial plane intersecting flank 21 directly adjacent to face 16. From this position planes 10, 47 can be steadily displaced in both opposing directions. Also so that plane 47 spacedly opposes face 16 and thus slants relative to plane 10. In the cited center position the clear width of gap 20 is at a minimum, it increasing steadily when varied in both directions as is evident from the positions indicated dot-dashed in FIG. 3. The minimum gap width is expediently more than one millimeter and less than three or five millimeters. Positioning movements of both positioning means 30, 39 result in such changes, it only being the positioning means 39 which establishes the smallest possible gap width.

Positioning means 40 permit mutually slanting adjustment of face 16 and axes 24, 46, on the one hand, and of guiding face 15 and axes 22, 25 on the other. The cited gap width settings remain constant over the positioning length of positioning means 40. Positioning means 40 set the one end, remote from positioning means 30, of unit 18, 37 about positioning axis 25 whilst the other end of this unit merely privots about frame-fixed axis 45, i.e. including the corresponding supporting flange 38' in each case. Axis 45 is always located in the same axial plane of axis 25 and is laterally juxtaposed with the axial planes of axes 22, 24, 46 oriented parallel thereto. It is possible by the positioning means 30 to translate axis 22 also in this common axial plane. The supporting flange 38' for the one flange 38 is adjustable by a guide 41 curved about axis 25, this guide comprising a guide pin engaging a curved slot with zero diametral clearance and rigidly connected to supporting flange 38'. The mounting about axis 45 oriented transverse or inclined to flank 21 or plane 10 is formed by a joint 42 or a mount comprising a joining pin located fixed to frame 6 in axis 45.

Each of the bearings 41, 42 comprises a mounting body 48 fixed to frame 6 laterally on the inside of the corresponding member 14. The one mounting body carries guide 41 and the other, in a bifurcated arrangement, the joining pin which passes through the corresponding supporting flange 38' between the forked arms of the corresponding mounting body 48. After this adjustment the unit 18, 37 needs to be locked only in the region of guide 41 by suitable means 43, for example by clamping. For this purpose a manually lever-operable clamping device is provided with which guide 41 can be axially tensioned relative to the corresponding mounting body 48. To facilitate manual adjustment along the guide 41 the corresponding supporting flange 38' is provided with a radially protruding handle 44 adjoining the inner side of this mounting body 48. Clamp 43 is accessible directly on the underside of the corresponding member 14.

Body 18 as shown in FIGS. 4 to 6 consists of an integral metal body the surface of which is coated overall or at least in the region of the four longitudinal edges 16 e.g. with a vacuum-deposited film of a harder substance, such as ceramic oxide film or the like maximally a tenth or half a tenth of a millimeter thick, for example. Body 18 is optionally turnable about its longitudinal center axis and about its transverse axis oriented at right angles thereto so that with respect to member 37 each of its four edges 16 can be optionally brought into the same working position for engaging the material 3. For this purpose fastening means 49 for reversible tool 18 comprise on both flat sides of reversible bit 18 countersinks for fastener bolts with which tool 18 can be tensioned optionally with both flat sides against the corresponding flat side of member 37. Edges 16 may have different radii of curvature so that one and the same tool 18 has working edges 16 for adapting to various working requirements.

Suction means 19 are stationary or not exposed to positional changes in operation and comprise a slot-shaped fluid or suction orifice 50 passing transversely through tool 18 in the middle between edges 16. Opening 50 is oriented parallel to edges 16 and in line between countersinks 49. The corresponding wall of member 37 is provided with a coincidental fluid orifice connecting the port of orifice 50 located in flank 21 to a flow passage 51. Passage 51 is bounded solely by the inner sides of profile 37, runs full length over the latter and has at one or both ends constricted connectors 52 which are provided for both gaps 20 at the remote outer sides of support flanges 38' and laterally adjacent to 41 or axis 45. To connectors 52 a flexible tube 53, e.g. a hose, connects and traverses the underside of the corresponding member 14. The other end of this tube is connected via a slanting connection 55 to a longitudinal passage 54. Secured to the other longitudinal section of each member 14 is one such longitudinal passage 54! having a rectangular or square cross-section, into the side wall of which the connection 55 issues at an acute angle inclined to the flow direction in passage 54 to eliminate flow losses. The end of passage 54 located nearer to the frame part of deflector 9 translates via a bend into a passage 56 oriented vertically upwards, the upper end of which is connected to a suitable pressure/suction source, such as a blower.

As shown in FIGS. 1 and 2 only one single simultaneously effective tool edge 16 is provided for each working zone or device 1 so that tool engagement is possible on one face only of the corresponding material 3. The configuration as shown in FIG. 3 is suitable for providing tool engagement optionally on both faces of the material 3. For this purpose identical units 18, 37 are secured separate to the same support flanges 38' on both sides of axial plane or axis 45 and adjustable about axis 46 independently of each other as as removable independently of each other. The working faces 16 of these two units spacedly oppose each other symmetrically to plane 45. Flanks 21 are counter inclined so that their planes 10 are oriented at an obtuse angle in a V-formation to each other. Cheeks 26, 27 likewise support two separate deflecting faces 15, 15' or identical deflection bodies 17 having separate deflection axes 22, 23 arranged symmetrically on both sides of an axial plane of positioning axis 25. In one position this axial plane coincides with plane 45 so that the material 3 is able to pass from deflector 8 to deflector 11 without contact between rolls 17 and tools 18, i.e. without being deflected in the working zone. By pivoting unit 17, 26, 27 in the one direction into the position as shown in FIG. 3 the material 3 is transferred from the deflection on one guiding face 15 with one material face into bending engagement of the other material face with the one bending face, namely the right-hand face 16. By pivoting in the opposite direction the material 3 is correspondingly brought into engagement with the other bending edge 16 by the other deflection face 15'.

Due to pivoting about axis 25 the angle of wrap at the corresponding edge 16 can be varied dynamically and continuously during operation. Thereby the wrap angle at the corresponding deflection face 15, 15' as well as the width of gap 20 are also changed. Gear 32 automatically locks each setting by the inner obstruction of its gear members. Independently of this, this wrap angle and gapwidth can be altered by positioning means 39. In this respect also the two flanges 38 could be displaced relative to each other in torsional deformation of unit 18, 37 to achieve differing wrap angles along the length of edge 16, as is possible by positioning means 40. However, the dynamic variation is undertaken not with tools 18 but with deflections 17 resulting in a very simple configuration of the suction means 19. Each passage 51 is connected to one of the connectors 52. All subdevices 1 are connected to a common longitudinal header passage 54. The cited ends of the two passages 54 are connected to the common riser passage 56 via the cited bend, configured as a Y-connector. Since the deflectors 17 cannot come into contact with tools 18 or other components of the device 1 even when fully rotated about axis 25 no means for restricting travel such as limit switches are needed. Each tool 18 or the tool edge 16 thereof may also be replaced by a rotating rod, the bearings of which are to be flanged to the support flanges 38' or provided on flanges 38. All components are located freely accessible thus greatly facilitating maintenance or insertion of the material 3.

As shown in FIG. 3 on the side of the deflector 17 facing away from tool 18, namely between deflectors 8, 17 or 11, 17 a further material guide 57 may be provided located nearer to deflector 17. Guide 57 does not deflect during bending but when the material 3 is guided past without contacting bending face 16 or at the most slightestly touching it. For each deflection face 15, 15' material guide 57 comprises a corresponding frame-fixed deflector 58, 58' or cylindrical rod or the like. In one position deflection face 15 forms with deflector 58 a tight passage gap for S-shaped reversing deflection of the material 3 and in the other position for likewise oppositely deflecting in the region of an equal deflector gap between deflection face 15' and deflector 58'. The material passes through the deflection gap in each case without any clamping pressure so that only one material face has deflector contact at any moment. Deflectors 58, 58' are secured to flanges 59 and thus secured adjustable and removable at a support flange 59' as already described with respect to flanges 38. Accordingly, here too, positioning means may be provided corresponding to means 39, 40, the deflectors 58, 58' like the deflectors 16 each being located eccentrically to the corresponding positioning axis.

In the embodiment shown in FIG. 10 the deflectors 17 are provided spacedly downstream of bending faces 16 and deflector 8 is located upstream of faces 16 as shown in FIG. 1. To engage and disengage passage control mode for non-worked passage of material 3 past the faces 16 the drive 31 is a power of fluid cylinder. Drive cylinder 31 comprises two separate cylinders each separately controllable and rigidly connected to each other in series. The pistons rods face away from each other. Each cylinder can be transposed separately into two end positions so that four stop-limited working strokes, namely that of each individual cylinder and the two working cylinders are achieved. Instead of the deflectors 17 being fixedly mounted to the frame the units 18, 37 or the supporting flange 38' are pivoted about axis 25 of deflector 8 by drive 31. Thereby each of the two tools 18 too, can optionally be brought into engagement with the material 3. Fine adjustment of the tool 18 or of its wrap angle is done manually via gearing such as a worm gear.

What is claimed is:

1. A setting device for bending layer material defining remote first and second layer faces, said setting device comprising:

a stationary base frame;

a running path defining a running direction and a cross-sectional running plane, and first and second guide faces for guiding the layer material, said first guide face including a bending face and said second guide face including a deflection face, said first and second guide faces being operationally directly interconnected by the layer material when passing between said first and second guide faces, and wherein dusting means are included for conveying dust away from said running path.

2. The setting device according to claim 1, wherein said dusting means include suction means directly connecting to at least one of said first and second guide faces.

3. A setting device for bending layer material defining remote first and second layer faces, said setting device comprising:

a stationary base frame;

a running path defining a running direction and a cross-sectional running plane, and first and second guide faces for guiding the layer material, said first guide face including a bending face and said second guide face including a deflection face, said first and second guide faces being operationally directly interconnected by the layer material when passing between said first and second guide faces, said first and second guide faces bounding a gap defining a gap shape for passing the layer material, said gap shape being operationally variable by displacing said first guide face with respect to said second guide face, between said first and second guide faces said gap defining a gap plane, and wherein an air port connects directly to said gap, said air port being positionally displaceable with said bending face and with respect to said deflection face.

4. A setting device for bending layer material defining remote first and second layer faces, said setting device comprising:

a stationary base frame;

a running path defining a running direction and a cross-sectional running plane, and first and second guide faces for guiding the layer material, said first guide face including a bending face and said second guide face including a deflection face, said first and second guide faces being operationally directly interconnected by the layer material when passing between said first and second guide faces, and a bending body including said bending face and exchangeably mounted on a support rod, wherein said support rod includes a hollow profile including angular internal cross-sections.

5. A setting device for bending layer material defining remote first and second layer faces, said setting device comprising:

a stationary base frame;

a running path defining a running direction and a cross-sectional running place, and first and second guide faces for guiding the layer material, said first guide face including a bending face and said second guide face including a deflection face, said first and second guide faces being operationally directly interconnected by the layer material when passing between said first and second guide faces, and a bending rod including said bending face, wherein said bending rod includes a fluid duct for operationally passing a fluid.

* * * * *